US010006319B2

(12) United States Patent
Wutzler et al.

(10) Patent No.: US 10,006,319 B2
(45) Date of Patent: Jun. 26, 2018

(54) CYLINDER HEAD OF AN INTERNAL COMBUSTION ENGINE WITH AT LEAST ONE CAMSHAFT

(71) Applicant: IAV GMBH Ingenieurgesellschaft Auto und Verkehr, Berlin (DE)

(72) Inventors: Joerg Wutzler, Zwickau (DE); Andreas Werler, Zwickau (DE)

(73) Assignee: IAV GMBH INGENIEURGESELLSCHAFT AUTO UND VERKEHR, Berlin (DE)

( * ) Notice: Subject to any disclaimer, the term of this patent is extended or adjusted under 35 U.S.C. 154(b) by 358 days.

(21) Appl. No.: 14/876,887

(22) Filed: Oct. 7, 2015

(65) Prior Publication Data

US 2016/0102587 A1 Apr. 14, 2016

(30) Foreign Application Priority Data

Oct. 8, 2014 (DE) ..... 10 2014 014 659

(51) Int. Cl.
*F01L 1/344* (2006.01)
*F01L 1/053* (2006.01)
(Continued)

(52) U.S. Cl.
CPC ..... *F01L 1/344* (2013.01); *F01L 1/047* (2013.01); *F01L 1/053* (2013.01); *F02F 1/24* (2013.01);
(Continued)

(58) Field of Classification Search
CPC . F01L 1/047; F01L 1/053; F01L 1/344; F01L 2001/0471; F01L 2001/0475; F01L 2001/0476; F01L 2013/0052; F02F 1/24
See application file for complete search history.

(56) References Cited

U.S. PATENT DOCUMENTS 5,359,970 A 11/1994 Krebs
8,225,759 B2 7/2012 Wutzler et al.
(Continued)

FOREIGN PATENT DOCUMENTS

DE 19519048 A1 11/1996
DE 10148179 A1 4/2003
(Continued)

*Primary Examiner* — Mark Laurenzi
*Assistant Examiner* — Wesley Harris
(74) *Attorney, Agent, or Firm* — Leydig, Voit & Mayer, Ltd.

(57) ABSTRACT

A cylinder head of an internal combustion engine includes a camshaft configured to actuate gas-exchange valves of the internal combustion engine. The camshaft has two cam segments that are joined to each other in such a manner that the cam segments cannot rotate with respect to each other, but are moveable axially relative to each other. End faces of the bearing sites of the cam segments each have splines running radially along respective outer circumferential surfaces of the cam segments. A camshaft bearing has an inner bearing ring with splines being formed on an inner surface. The splines of the inner bearing ring completely penetrate the axial course of the inner surface and the splines of the adjacent cam segments intermesh with the splines of the inner bearing ring on both sides thereof such that the inner bearing ring forms a non-rotating connection between the camshaft segments.

5 Claims, 1 Drawing Sheet

(51) Int. Cl.

| | |
|---|---|
| ***F01L 1/047*** | (2006.01) |
| ***F02F 1/24*** | (2006.01) |
| *F01L 13/00* | (2006.01) |

(52) U.S. Cl.

CPC ..... *F01L 2001/0471* (2013.01); *F01L 2001/0475* (2013.01); *F01L 2001/0476* (2013.01); *F01L 2013/0052* (2013.01)

(56) References Cited

U.S. PATENT DOCUMENTS

| | | | | |
|---|---|---|---|---|
| 2010/0139594 | A1 | 6/2010 | Wutzler et al. | |
| 2010/0175652 | A1* | 7/2010 | Schoeneberg ..... | F01L 1/047 123/90.21 |
| 2010/0251982 | A1 | 10/2010 | Elendt et al. | |
| 2011/0180029 | A1 | 7/2011 | Andreas et al. | |
| 2012/0227689 | A1 | 9/2012 | Bechtold | |
| 2012/0285408 | A1 | 11/2012 | Richter | |
| 2012/0291731 | A1 | 11/2012 | Parsche | |
| 2013/0000442 | A1 | 1/2013 | Wiesner et al. | |
| 2013/0025554 | A1 | 1/2013 | Werler et al. | |
| 2014/0109851 | A1* | 4/2014 | Kirbach ..... | F01L 1/053 123/90.15 |
| 2017/0248043 | A1* | 8/2017 | Kaan ..... | F01L 1/34 |

FOREIGN PATENT DOCUMENTS

| | | | |
|---|---|---|---|
| DE | 102004021376 | A1 | 12/2005 |
| DE | 102004021375 | A1 | 1/2006 |
| DE | 102007010150 | A1 | 9/2008 |
| DE | 102007010155 | A1 | 9/2008 |
| DE | 102007027979 | A1 | 1/2009 |
| DE | 102008024876 | A1 | 11/2009 |
| DE | 102008061440 | A1 | 6/2010 |
| DE | 102009021650 | A1 | 11/2010 |
| DE | 102009056224 | A1 | 6/2011 |
| DE | 102010004579 | A1 | 7/2011 |
| DE | 102010004591 | A1 | 7/2011 |
| DE | 102010005790 | A1 | 7/2011 |
| DE | 102010014249 | A1 | 10/2011 |
| DE | 102010020035 | A1 | 11/2011 |
| DE | 102010022709 | A1 | 12/2011 |
| DE | 102010047993 | A1 | 4/2012 |
| DE | 102011005191 | A1 | 8/2012 |
| DE | 102011001711 | A1 | 10/2012 |
| DE | 102011101400 | A1 | 11/2012 |
| DE | 102011101868 | A1 | 11/2012 |
| DE | 102011108728 | A1 | 1/2013 |
| DE | 102012106216 | A1 | 5/2014 |
| EP | 2126292 | A1 | 12/2009 |
| WO | WO 2008012306 | A1 | 1/2008 |
| WO | WO 2009056427 | A1 | 5/2009 |
| WO | WO 2009065478 | A1 | 5/2009 |
| WO | WO 2011072782 | A1 | 6/2011 |

* cited by examiner

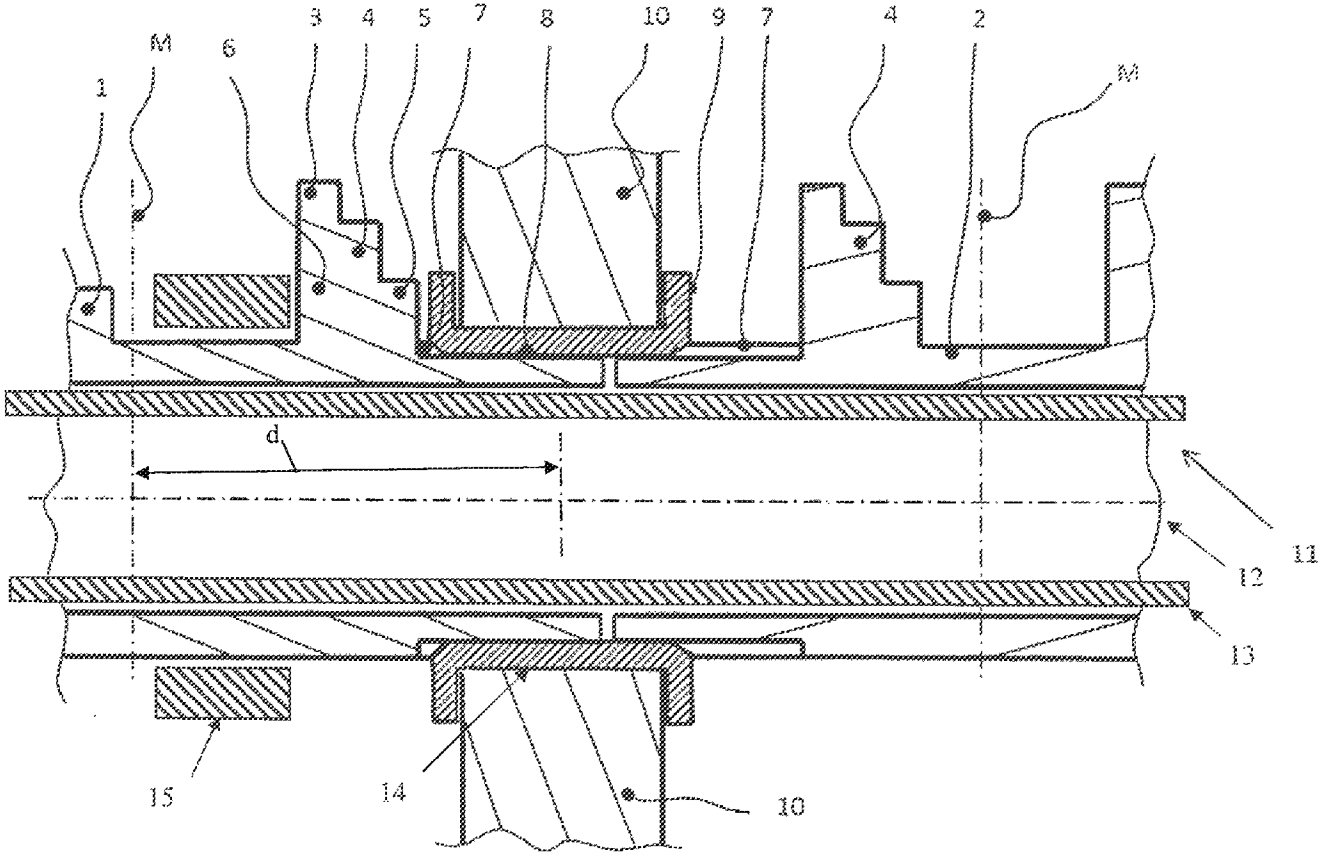
11
12
13
M
2
4
7
9
10
8
7
5
4
3
6
M
1
d
10
14
15

CYLINDER HEAD OF AN INTERNAL COMBUSTION ENGINE WITH AT LEAST ONE CAMSHAFT

CROSS-REFERENCE TO PRIOR APPLICATION

Priority is claimed to German Patent Application No. DE 10 2014 014 659.6, filed on Oct. 8, 2014, the entire disclosure of which is hereby incorporated by reference herein.

FIELD

The invention relates to a cylinder head of an internal combustion engine with at least one camshaft for actuating the gas-exchange valves of an internal combustion engine.

BACKGROUND

German patent application DE 10 2011 101 868 A1 describes a device for varying the charge-exchange valve stroke, whereby a cam segment that supports a cam group with cams having different stroke contours is arranged so as to be axially movable on a base shaft. The cam segment and the base shaft are splined with each other so that a torque-proof coupling between the camshaft and the cam segment is ensured and the cam segments can move axially via a transmission element that is actuated by another control shaft.

Another stroke-variable valve drive is known from German patent application DE 10 2011 108 728 A1. An axially movable cam segment with several cams having different stroke contours is actuated by a control shaft that is located inside the camshaft. The cam segments are splined with a base shaft, causing them to be supported in the cylinder head, whereby the cam segment has a sliding bearing surface that interacts with a slide bearing that is supported in the cylinder head. The use of a slide bearing is necessary since—when the cam segments are supported between the cam groups in a plane near the cylinder axis—the installation space for a multi-stage shifting mechanism of the valve stroke is limited.

Another stroke-variable valve actuating mechanism is disclosed in German patent application DE 10 2010 005 790.8. A bearing arranged on an axially movable cam segment is used for axially positioning the cam segment, whereby a movement of the bearing by means of a control shaft brings about the effective shifting of the different cam contours of the cam segment for the valve actuating mechanism.

In the case of multi-stage shifting systems, supporting the camshaft or cam segments close to the cylinder axis causes problems in terms of the installation space available between the valves, so that, as an alternative, the support can be effectuated on the end faces of the cam segments. An example of this is shown in German patent application DE 195 19 048 A1. The cam segment that has the cam groups is widened at its ends faces, and bearing surfaces are created around the circumferential surfaces; these bearing surfaces—together with a sliding surface configured in the cylinder head—form the sliding bearing for the cam segment.

Another bearing for axially movable cam segments on the end faces is shown in German patent applications DE 10 2008 024 876 A1 and DE 10 2009 021 650 A1. Here, the cam segments are provided with sliding surfaces on their circumferential surfaces for which there are sliding surfaces in the cylinder head that form a corresponding counter-bearing. Therefore, the camshaft is supported by means of a sliding bearing formed on the end face of the camshaft segments and on the cylinder head.

German patent application DE 10 2010 047 993 A1 discloses supporting the base shaft on bearing bushings that rotate along and that are splined with the base shaft. Here, the bearing bushings form stop surfaces for cam segments that can be moved axially on the camshaft.

SUMMARY

In an embodiment, the present invention provides a cylinder head of an internal combustion engine includes at least one camshaft configured to actuate gas-exchange valves of the internal combustion engine. The at least one camshaft has at least two cam segments that are joined to each other in such a manner that the cam segments cannot rotate with respect to each other, but are moveable axially relative to each other. The cam segments have at least one cam group that has at least two different, directly adjacent cams having different stroke curves. Each of the cam segments has an end face with a bearing site whereby the camshaft is supported in the cylinder head. The end faces of the bearing sites of the cam segments each have splines running radially along respective outer circumferential surfaces of the cam segments. A camshaft bearing has an inner bearing ring with splines being formed on an inner surface of the inner bearing ring. The splines of the inner bearing ring are complementary to the splines of the cam segments, wherein, starting from a respective one of the end faces, the splines of the cam segments each extend along part of an axial extension of a respective one of the cam segments and intermesh with the splines of the inner bearing ring. The splines of the inner bearing ring completely penetrate an entire axial course of the inner surface of the inner bearing ring and the splines on the end face of each of the adjacent cam segments intermesh with the splines of the inner bearing ring on both sides of the inner bearing ring such that the inner bearing ring forms a torque-proof coupling between the camshaft segments.

BRIEF DESCRIPTION OF THE DRAWING

The present invention will be described in even greater detail below based on the exemplary FIGURE. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawing which illustrates the following:

FIG. 1 shows a camshaft having two cam segments according to an embodiment of the invention.

DETAILED DESCRIPTION

The inventors have recognized that a drawback of the prior-art bearings for axially movable cam segments is that, when these cam segments are supported on their end faces, the sliding contact that rotates with the cam segment moves in the bearing bushing. Moreover, depending on the axial positioning of the cam segments, the bearing load is asymmetrical.

In an embodiment, the present invention provides a cylinder head of an internal combustion engine that is configured with at least one camshaft in order to actuate gas-exchange valves in such a way as to enable a low-wear bearing of axially movable camshaft segments.

The cylinder head of an internal combustion engine has at least one camshaft for actuating the gas-exchange valves of the internal combustion engine. In order to change over to the stroke contour that is effective for the gas-exchange valves, cam segments are moved axially by means of actuation means known from the state of the art. In order to ensure an axial movement of the cam segments, the camshaft consists of at least two cam segments that are coupled to each other in a torque-proof manner but that can be moved axially relative to each other. The cam segments have at least one cam group that, directly adjacently, has at least two different cams having different stroke curves. The stroke curves of the cam groups formed on the cam segments preferably comprise cams whose maximum stroke differs, whereby a zero delivery can also be effectuated for a valve cutout. The end faces of the cam segments each have a bearing site to support the camshaft in the cylinder head, whereby—according to the invention—at least two adjacent cam segments are advantageously supported in a bearing bushing which rotates along with said cam segments and in which the cam segments can be moved. The camshaft is guided via the bearing bushing that rotates along with the cam segments and that is supported on a counter-bearing in the cylinder head. For this purpose, the end faces of the bearing sites of the cam segments each have splines running radially on their outer circumferential surface. Starting from the end face, these splines extend along part of the axial extension of the cam segment. The length of the splines is greater than the distance of their axial movement. These splines intermesh with splines that are complementary to the former, and the latter are formed on the inner surface of an inner bearing ring of a camshaft bearing formed in the cylinder head. The splines completely penetrate the axial course of the inner bearing ring so that the end faces of the cam segments that are splined with the inner bearing ring can be moved axially therein.

On at least one of the end faces of the cam segment, there is another cam segment that is arranged in the inner bearing ring, and the splines on the end face of said cam segment intermesh with the complementary splines of the inner bearing ring. The bearing ring thus establishes a torque-proof coupling between the camshaft segments and, owing to the splining thereof, allows an axial movement of the camshaft segments with each other as well as relative to each other. The axially movable contact surfaces between the cam segments and the inner bearing ring are formed by splines, whereby the function of the rotating bearing is taken over by the outer circumferential surface of the inner bearing ring. The inner bearing ring is in a fixed position in the axial direction so that the surfaces of the camshaft bearing—configured as a sliding bearing or roller bearing—that rotate relative to each other do not have any bearing surfaces that can move axially relative to each other, since the axial movement is achieved with the bearing ring in the splines of the cam segments that are non-rotatably secured relative to each other. The inner bearing ring is stressed virtually to an equal extent by the two cam segments that are inserted on opposite sides into the splines of the inner bearing ring. Even when the cam segments move axially and consequently create different contact widths with the splines of the inner bearing ring, there is always a radial stress on both sides of the inner bearing ring.

In a preferred embodiment of the invention, the inner bearing ring is positioned immovably in the cylinder head in the axial direction of the camshaft relative to the latter, whereby the outer circumferential surface 14 of the bearing ring is configured as a sliding bearing that is rotatably held in a bearing seat formed in the cylinder head, or else it is rotatably held in a bearing shell arranged therein. As an alternative, the outer circumferential surface 14 of the bearing ring can be rotatably supported on rolling elements in an outer bearing shell held in the cylinder head, whereby the inner bearing ring, the rolling elements and the outer bearing ring together form a roller bearing for the camshaft segments.

According to an embodiment of the invention, the cam segments are advantageously supported on their end faces in a plane that, relative to the cylinders of the internal combustion engine, runs at a distance from the center axis of the cylinders in the in-between edge areas of the cylinder. Therefore, according to an embodiment of the invention, the cam segments are supported outside of the very limited installation space between the valves, an approach that, due to the width of the cam packets, is especially advantageous in case of multi-stage shifting systems.

In an advantageous embodiment of the invention, at least some of the actuators that determine the positioning of the cam segment engage in a position that, as seen in the axial extension of the camshaft, is located between the bearing sites of the cam segment. An example of an actuator 15 that determines the cam position is disclosed in German patent application DE 10 2008 061 440 A1, in which pins arranged circumferentially along the cam segments engage with a link positioned by means of a control shaft. Additional examples of actuators are given in German patent applications DE 10 2010 005 790 A1 as well as DE 10 2011 101 868 A1. With these actuators, transmission elements that are situated on the cam segment and that can be positioned by the actuators in the axial direction are used for positioning the cam segments in the axial direction. The entire disclosures of each of DE 10 2008 061 440 A1, DE 10 2010 005 790 A1 and DE 10 2011 101 868 A1 are hereby incorporated by reference herein.

In one embodiment, the camshaft can consist merely of the cam segments that are non-rotatably joined to each other by means of the inner bearing ring. For this purpose, there is no need for a base shaft on which the cam segments are arranged. In an alternative embodiment, the cam segments have holes 12 in the axial direction of the camshaft, and a base shaft 13 passes through these holes. Here, the cam segments can be held so as to be non-rotatable and axially movable relative to the cam segments on this base shaft 13 by means of splines of the base shaft. In this embodiment, the base shaft has splines on its outer circumferential surface into which splines intermesh that are complementary thereto and that are formed on the inner circumferential surfaces by the hole 12 running in the axial direction through the cam segments.

An embodiment of the invention is described below with reference to FIG. 1. Two cam segments 1, 2 support cam groups 6 that have directly adjacent cams 3, 4, 5 with a different cam contour. In order to effectively change to the various cams 3, 4, 5, the cam segments can be moved along their axial extension by means of actuators. The cam segments 1, 2 each have splines 7 on their end faces surrounding the outer circumferential surface, and these splines 7 intermesh with complementary splines 8 that are formed on the inner circumferential surface of an inner bearing ring 9. The bearing ring 9 is supported by means of a sliding pair in a camshaft bearing 10 of the cylinder head. The bearing ring 9, into which the cam segments 1, 2 are inserted so as to be splined on both sides with said bearing ring 9, forms the camshaft 11 together with said cam segments 1, 2. The camshaft 11 rotates in the camshaft bearings 10 of the cylinder head, whereby the cam segments 1, 2 are coupled to each other in a torque-proof manner by means of the splines 7 of the cam segments 1, 2, which intermesh with the splines 8 of the inner bearing ring 9. Thus, the cam segments 1, 2 cannot rotate with respect to each other. In the axial extension of the camshaft, the cam segments 1, 2 can be moved in the inner bearing ring 9.

The cam segments 1, 2 can be moved together or else relative to each other. The camshaft bearing 10 in the cylinder head is situated at a distance d from the center axes M of the cylinders in their edge area. The depicted section of the camshaft shows a camshaft bearing 10 for two cam segments 1, 2 that is arranged between the center axes M of the cylinders. The number of cam segments 1, 2 can be increased by being expanded by an identical structure; therefore, camshafts for any number of cylinders can be formed, and each of the cam segments 1, 2 can be moved axially independently of the other ones. Thus, for instance, cylinder-individual valve cutouts can be created for multi-cylinder motors. Diverging from the depiction shown here, the cam segments 1, 2 can be supported on a base shaft that extends inside the cam segments 1, 2. The cam segments 1,2 can have radially circumferential splines that intermesh with complementary splines of the base shaft. The cam segments 1, 2 are thus held so that they cannot rotate relative to each other, but are axially movable on the base shaft.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

What is claimed is:

1. A cylinder head of an internal combustion engine, the cylinder head comprising:

at least one camshaft configured to actuate gas-exchange valves of the internal combustion engine, the at least one camshaft having at least two cam segments that are joined to each other in such a manner that the cam segments cannot rotate with respect to each other, but are moveable axially relative to each other, the cam segments having at least one cam group that has at least two different, directly adjacent cams having different stroke curves, each of the cam segments having an end face with a bearing site whereby the camshaft is supported in the cylinder head, the end faces of the bearing sites of the cam segments each having splines running radially along respective outer circumferential surfaces of the cam segments; and a camshaft bearing having an inner bearing ring with splines being formed on an inner surface of the inner bearing ring, the splines of the inner bearing ring being complementary to the splines of the cam segments, wherein, starting from a respective one of the end faces, the splines of the cam segments each extend along part of an axial extension of a respective one of the cam segments and intermesh with the splines of the inner bearing ring, the splines of the inner bearing ring completely penetrating an entire axial course of the inner surface of the inner bearing ring and the splines on the end face of each of the adjacent cam segments intermeshing with the splines of the inner bearing ring on both sides of the inner bearing ring such that the inner bearing ring forms a non-rotating connection between the camshaft segments.

2. The cylinder head according to claim 1, wherein the inner bearing ring is positioned immovably in the cylinder head in an axial direction of the camshaft, an outer circumferential surface of the inner bearing ring rotatably held in the camshaft bearing.

3. The cylinder head according to claim 1, wherein, relative to cylinders of the internal combustion engine, the camshaft is supported at a distance from a center axis of each of the cylinders.

4. The cylinder head according to claim 1, comprising at least one actuator disposed axially between the bearing sites of the cam segments to determine the axial positioning of the cam segments.

5. The cylinder head according to claim 1, wherein the cam segments have a hole along an axial course of the camshaft, whereby the cam segments are non-rotatably and axially held on the base shaft relative to the cam segments.

* * * * *